US010175000B2

(12) United States Patent
Shea

(10) Patent No.: US 10,175,000 B2
(45) Date of Patent: Jan. 8, 2019

(54) HEAT DOME TEMPERATURE REGULATION SYSTEM

(71) Applicant: James P. Shea, Waterford, MI (US)

(72) Inventor: James P. Shea, Waterford, MI (US)

( * ) Notice: Subject to any disclaimer, the term of this patent is extended or adjusted under 35 U.S.C. 154(b) by 94 days.

(21) Appl. No.: 15/424,451

(22) Filed: Feb. 3, 2017

(65) Prior Publication Data

US 2017/0227291 A1 Aug. 10, 2017

Related U.S. Application Data

(60) Provisional application No. 62/291,316, filed on Feb. 4, 2016.

(51) Int. Cl.
*F27D 27/00* (2010.01)
*F27D 3/00* (2006.01)

(52) U.S. Cl.
CPC ..... *F27D 27/00* (2013.01); *F27D 3/0025* (2013.01)

(58) Field of Classification Search
CPC ..... F27D 27/00; F27D 3/0025
USPC ..... 126/343.5 R, 343.5 A
See application file for complete search history.

(56) References Cited

U.S. PATENT DOCUMENTS 2,291,083 A * 7/1942 Jung ..... F27D 1/0006 126/343.5 A
2,778,922 A * 1/1957 Birkner, Jr. ..... B01F 7/247 126/343.5 A
3,321,281 A * 5/1967 Lynn ..... C09C 1/50 422/158
2006/0133194 A1* 6/2006 Takahashi ..... B01F 5/102 366/147

* cited by examiner

*Primary Examiner* — Avinash Savani
(74) *Attorney, Agent, or Firm* — Brinks Gilson & Lione

(57) ABSTRACT

A thermoplastic melter kettle having a heat dome chamber from which combustion gases are exhausted through a conduit that connects between a top of the heat dome chamber and the top of the melter kettle. An adjustable venting arrangement coupled to the conduit allows for adjustment of the flow of exhaust gases through the conduit.

20 Claims, 4 Drawing Sheets

HEAT DOME TEMPERATURE REGULATION SYSTEM

RELATED APPLICATION

The present application is based upon United States Provisional Application Ser. No. 62/291,316, filed Feb. 4, 2016 to which priority is claimed under 35 U.S.C. § 120 and of which the entire specification is hereby expressly incorporated by reference.

BACKGROUND

The present invention relates generally to melter kettles that are designed and used to melt thermoplastic materials that are applied to pavements such as roadways, airport runways, parking lots, bicycle paths and other surfaces requiring pavement markings. More particularly the present invention is directed to systems and methods to regulate heat in melter kettles that have heat domes.

A variety of thermoplastic materials and compositions have been developed and used in the roadway striping industry. In order to apply such thermoplastic materials and compositions, they have to be melted and mixed. Melting, which involves both initial melting from solid stock or feed materials and maintaining the materials/compositions in a molten state for application onto roadways and other pavements, is typically conducted in melter kettles (also referred to herein as "melting kettles") which can be heated by electrical means, or by burning combustible fuels.

Thermoplastic materials/compositions are the current products of choice for many types of marking applications. However, unlike most other types of marking materials thermoplastic materials/compositions must be melted for use. Thermoplastic materials/compositions can be applied by various methods such as spraying, extruding, and screeding. In order to be applied to pavement surfaces the thermoplastic materials/compositions need to be melted and heated to a sufficiently high temperature so as to adjust their viscosity as needed for a particular type of application process. In addition the temperature has to be controlled to avoid scorching.

The process of pavement marking using thermoplastic materials/composition is limited in time to how long it takes to melt the thermoplastic materials/compositions and heat them to a suitable application temperature. Older melting kettles were basically cylindrical tanks that were provided with combustion chambers on their bottoms.

Originally thermoplastic materials used for pavement markings were heated using a double boiler method. A heat source such as a propane burner or a diesel burner would heat high temperature heat transfer oil to about 420° F. in a vessel (oil bath) that contained the heat transfer oil. A vessel designed to hold solid or granular thermoplastic material was encased by the oil bath. The material in the "kettle" was agitated to allow for even heating as well as maintaining a homogeneous mixture of the thermoplastic components. This was a slow melting process however the equipment used at that time was rudimentary such that the slow melting times of the thermoplastic materials matched the low production rates. First applications were performed using drag boxes. Not much material was placed in a day.

The next improvement in reducing thermoplastic melting times was the elimination of the double boiler oil bath method. First propane and later diesel fired burners with the flame directed on the kettle bottom were developed. The direct flame deformed the kettle bottom causing premature kettle failure. Sacrificial baffles were placed between the flame and kettle solving this problem. About the same time improvements were being made on melting thermoplastic, materials, other improvements were being made on more efficient application methods. The development of hand carts replaced drag boxes, followed by mobilized application applicators. Truck mounted applicators were later developed. However, these early types of applicators could only be filled using gravity methods and were limited to low capacities of a single color thermoplastic material.

As methods of transferring thermoplastic materials into melting kettles were developed that did not rely solely upon gravity, applicator truck capacities also improved dramatically. The newer trucks were developed that could carry, melt and apply more than one color of thermoplastic material. Application speeds increased and daily application capabilities increased. Application output increased from 1 ton/day in the drag box era (on a good day), to 30 tons/day for crews using modern equipment.

There remained a need to further improve kettle melting efficiencies. Heat domes of different sizes were introduced to improve the melting efficiencies of thermoplastic materials in melter kettles. The goal of heat domes was to increase the surface area of the internal thermoplastic kettle walls that are in contact with the thermoplastic volume, thereby allowing increased heat transfer to the thermoplastic materials therein. As compared to melting kettles that do not have heat domes, melting kettle having heat domes significantly reduce the melting time of thermoplastic materials using identical melting procedures. The design of heat domes was not based on actual engineering data but rather based merely on trial and error.

Heat domes (also referred herein to as "heat dome chambers") are closed top chambers that are extend upward into the bottoms of melter kettles in a central portion thereof above lower combustion chambers. The walls and top of heat domes provide addition heat transfer surface are between the combustion chamber and thermoplastic material within a melting kettle.

The present invention provides for controlling the rate of heat exchanges from the heat domes in melting kettles. In this regard according to one aspect the present invention provides for regulating the outflow of air from heat domes in melting kettles from zero to full exhaust out flow. The present invention further allows for measurement of outflow rate and temperature.

BRIEF SUMMARY

According to various features, characteristics and embodiments of the present invention which will become apparent as the description thereof proceeds, the present invention provides a melter kettle comprising:

an interior space for receiving thermoplastic material to be melted;

a combustion chamber in the bottom of the melter kettle;

a heat dome chamber that extends above the combustion chamber; and an exhaust conduit that extends between the heat dome chamber and a top of the melter kettle for exhausting combustion gases received in the heat dome chamber from the combustion chamber.

The present invention further provides for an improvement in melter kettle designs having heat domes which improvement includes providing an exhaust gas conduit between the top of the heat dome chamber and the top of the melter kettle through which exhaust gas conduit combustion gases received in the heat dome chamber can be exhausted from the top of the melter kettle.

The present invention further provides a method of melting a thermoplastic material in a melter kettle having a heat dome chamber and a combustion chamber, said method comprising:

charging thermoplastic material into the melter kettle;

combusting a fuel source in the combustion chamber; and exhausting combustion gases from a top of the heat dome chamber to a top of the melter kettle through an exhaust conduit.

BRIEF DESCRIPTION OF THE DRAWINGS

The present invention will be described with reference to the attached drawings which are given as non-limiting examples only, in which.

DETAILED DESCRIPTION OF THE DRAWINGS AND THE PRESENTLY PREFERRED EMBODIMENTS

The present invention provides for controlling the rate of heat exchanges from the heat domes in melting kettles. According to one aspect the present invention provides for regulating the outflow of air from heat domes in melting kettles from zero to full exhaust. The present invention further allows for measurement of outflow rate and temperature.

The present invention significantly reduces thermoplastic melting times in thermoplastic kettles with or without domes thereby increasing practical application rates of thermoplastic pavement marking procedures. The faster melting times increase production, reduce labor costs, and save money. The system will also assist in cooling the melter kettle down sooner. The system design uses accepted engineering standards to achieve performance improvements over prior melter kettle designs that incorporated rough trial and error heat dome designs.

Figure 1:
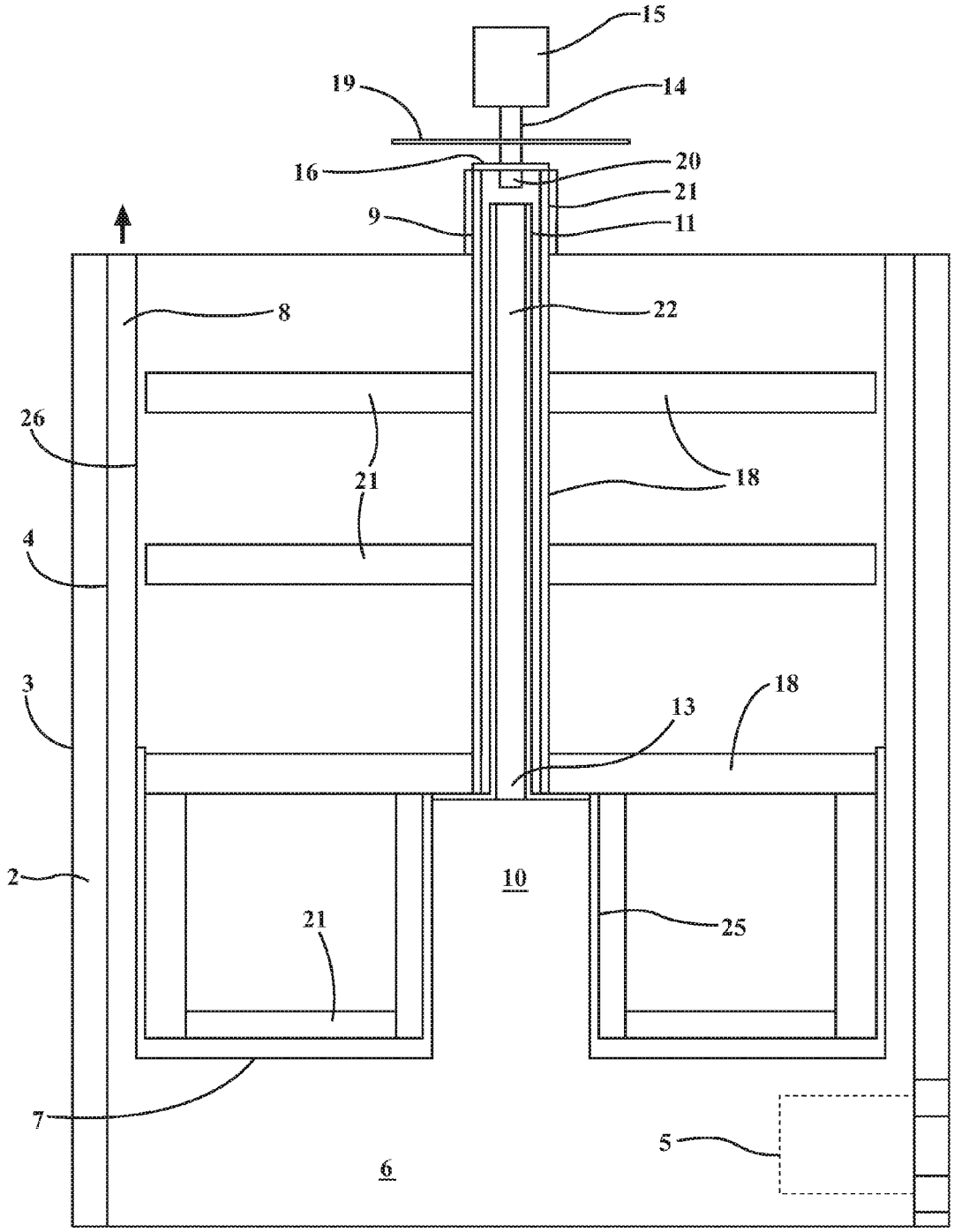
FIG. 1 is a cut away side view of a thermoplastic melter kettle with a heat dome and heat regulating assembly according to one embodiment of the present invention.

FIG. 1 is a cut away side view of a thermoplastic melter kettle with a heat dome and heat regulating assembly according to one embodiment of the present invention.

The thermoplastic melter kettle 1 depicted in FIG. 1 has a cylindrical shape with an annular insulation chamber 2 defined between an outer kettle skin 3 and an outer heat chamber skin. The insulation chamber 2 is provided to contain heat within the melter kettle and protect personnel coming into contact with the melter kettle from getting burned. A combustion chamber 6 is provided at the bottom of the melter kettle 1. A burner 5 directs a flame into the combustion chamber 6 that heats the bottom 7 of the melter kettle 1. The combustion chamber 6 includes appropriate air vents (not shown) that allow sufficient air into the chamber to support a burner flame that can be produced by burning a combustible fuel such as propane or diesel fuel. In alternative embodiments multiple burners of various configurations can be used that produce multiple flames in the combustion chamber 6.

Combustion heat generated in the combustion chamber 6 heats the bottom 7 of the melter kettle. The outer kettle wall 26 is also heated as hot combustion gases travel up the annular side heat chamber 8. Heat depleted combustion gases exit the kettle side heat chamber 8 through exhaust stack 9 located at the top of the kettle side heat chambers 8.

The melter kettle 1 includes a modified heat dome chamber 10 that is modified so that a dome chimney tube 11 has a base that is welded to an opening in the center of the heat dome top 13. The heat dome chamber 10 has a cylindrical shape and is defined by a cylindrical heat dome wall 25 and heat dome top 13.

A modified agitator assembly 18 for stirring thermoplastic materials in the melter kettle is provided that has a shortened solid drive shaft 14 that is driven by a motor 15 and is connected to the center of the solid tube drive shaft cap 16. The solid tube drive shaft cap 16 is connected to the top of tube drive shaft 17 which rotates about the fixed dome chimney tube 11 by motor 15. The agitators 21 can have a standard configuration to achieve mixing and are connected to the tube drive shaft 17 so as to rotate with drive shaft 17 about the fixed dome chimney tube 11.

Figure 2:
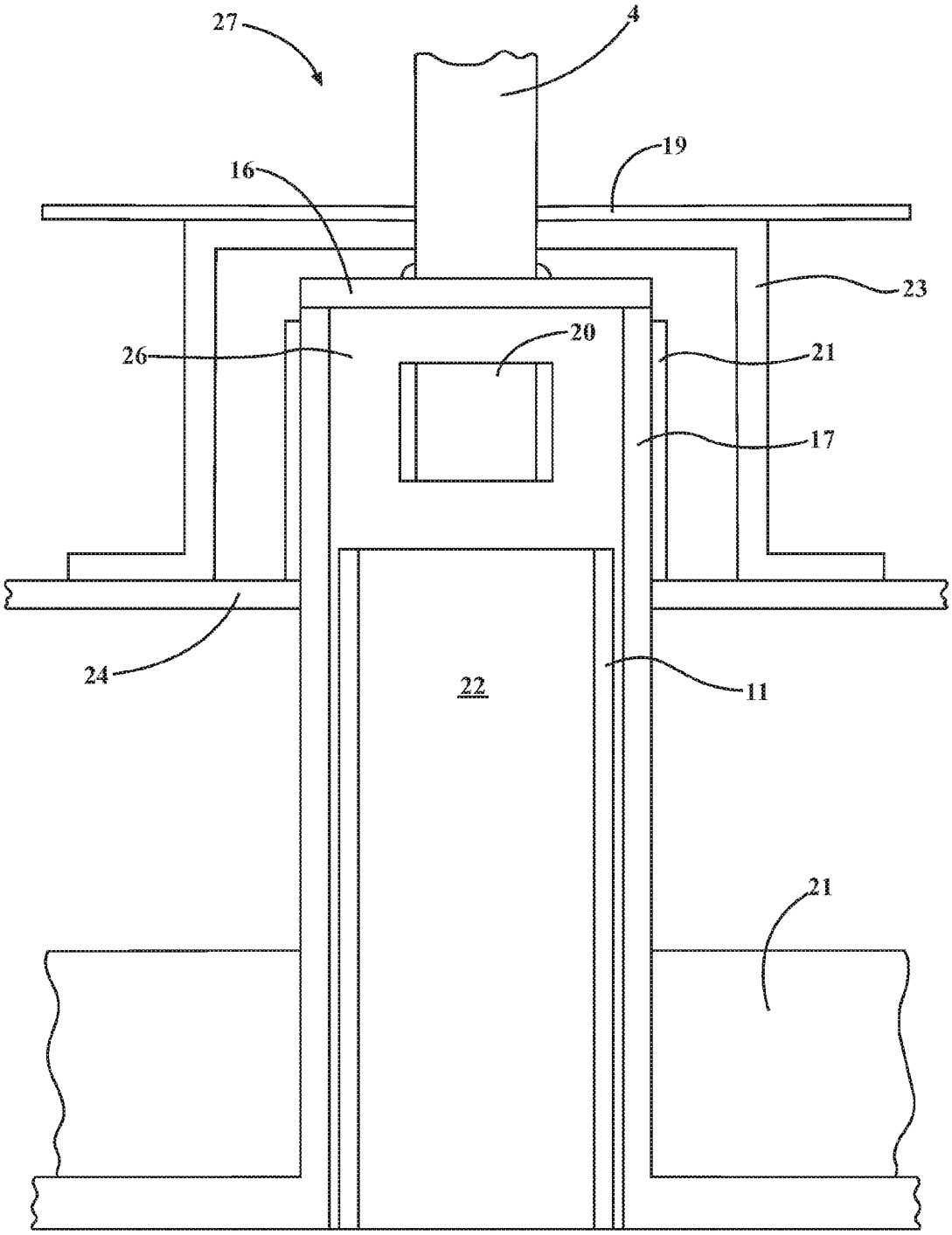
FIG. 2 is an enlarged side view of the top portion of the heat dome chimney tube of FIG. 1 and dome chimney tube venting assembly.

FIG. 2 is an enlarged side view of the top portion of the heat dome chimney tube of FIG. 1 and dome chimney tube venting assembly.

An upper assembly 27 is provided at the top the melter kettle 1 which includes a mounting bracket 23 that that supports the short solid drive shaft 4 and drive motor 15 (FIG. 1) to the top of the melter kettle with the short drive shaft 4 attached to the tube drive shaft cap 16 for rotating the tube drive shaft 17 about the chimney tube wall 11. A bi-directional or reversible drive motor can be used to in place of a uni-directional drive motor to rotate the tube drive shaft 17 (and agitators 21 attached thereto) if desired. The mounting bracket 23 can have an inverted "U" shape as depicted or be of any convenient shape.

Figure 3:
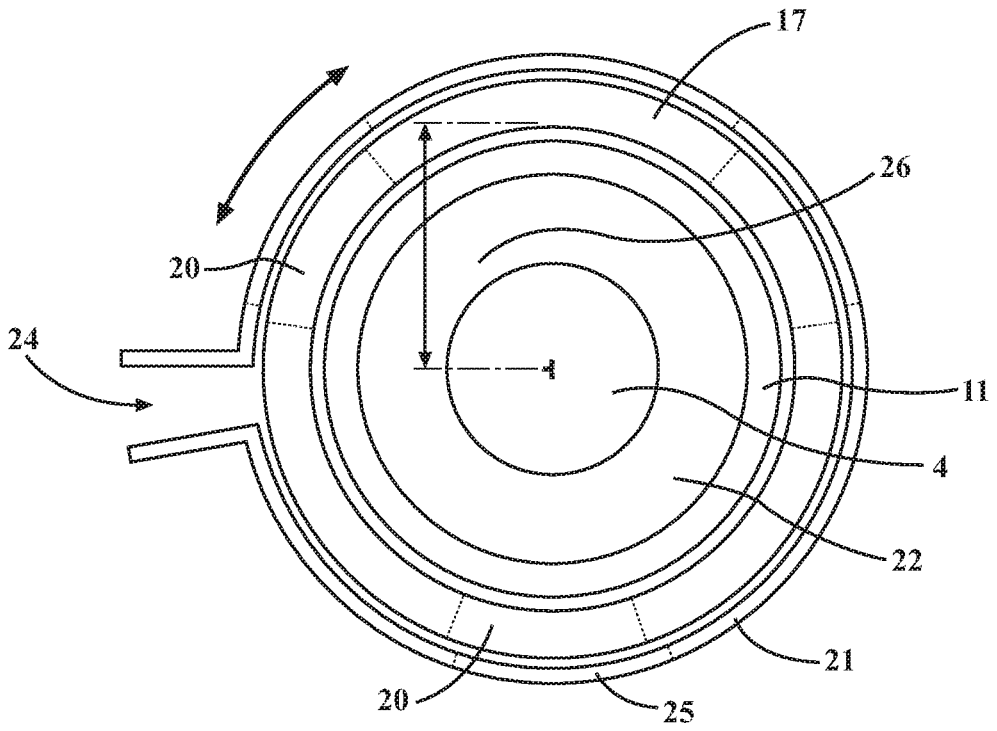
FIG. 3 is a top view of the solid drive shaft, rotational vent relief collar, tube drive shaft, dome chimney tube, drive shaft tube relief valve, rotational vent relief collar and the dome chimney tube stack of FIGS. 1 and 2.

Heat regulation is provided by according to the present invention by the top drive shaft heat assembly that allows heat depleted combustion exhaust gases to transfer upwards from the heat dome chamber 10 through the dome chimney tube stack 22 and into the top tube drive shaft heat chamber 26 (FIG. 3).

The construction of the present invention allows heat depleted combustion exhaust gases to exit from the heat dome chamber 10 through the dome chimney tube stack tube 22 rather than exhausting entirely through the exhaust stack 9 of the kettle side heat chamber 8. In addition, the construction of the present invention allows for controlling the rate, amount or proportion of combustion exhaust gases that from the heat dome chamber 10 through the dome chimney tube stack tube 22 from full flow to no flow. This control is achieve by providing drive shaft tube relief vents 20 in top the wall of the tube drive shaft 17 and providing a rotational vent relief collar 21 with rotational relief collar vents 25 around the top portion of the tube drive shaft 17. When the drive shaft tube relief vents 20 are aligned with the rotational relief collar vents full flow of heat depleted combustion gases is achieved. Partial alignment of the drive shaft tube relief vents 20 with the rotational relief collar vents allows for proportionally less flow of heat depleted combustion gases. It is noted that the rotational relief collar 21 can be manually rotated about the tube drive shaft 17 in either direction and once manually positioned rotates with the tube drive shaft 17. As shown in FIGS. 1 and 2 a heat deflector 19 is provided beneath drive motor 15 to deflect exhaust gases outward away from the drive motor 15.

Figure 4:
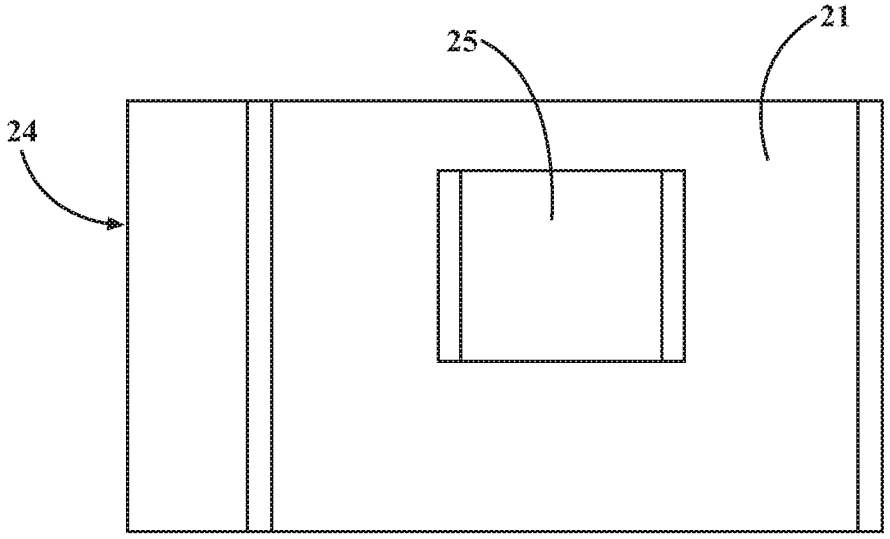
FIG. 4 is a side view of the rotational vent relief collar of FIGS. 1 and 3.

FIG. 3 is a top view of the solid drive shaft, rotational vent relief collar, tube drive shaft, dome chimney tube, drive shaft tube relief valve, rotational vent relief collar and the dome chimney tube stack of FIGS. 1 and 2. FIG. 4 is a side view of the rotational vent relief collar of FIGS. 1 and 3.

The manner in which combustion exhaust gases are regulated to flow out from the heat dome chamber 10 will be described in reference to FIGS. 3 and 4. Combustion gases in combustion chamber 6 enter heat dome chamber 10 as understood from the description of FIG. 1 above. The combustion exhaust gases in heat dome chamber 10 pass upward through the heat dome chimney stack 22 into the top tube drive shaft heat chamber 26 where the rate of exhaust is regulated by rotating the rotational relief collar 21. In the top tube drive shaft heat chamber 26 the exhaust gases received from the heat dome chimney stack 22 are contained within the top portion of tube drive shaft 17. When the drive shaft tube relief vents 20 are aligned with the rotational relief collar vents 25 in the rotational relief collar 21 the exhaust gases within the top portion of tube drive shaft 17 are allowed to exhaust into the ambient atmosphere.

Shown in FIGS. 3 and 4 is the concentric arrangement of the solid drive shaft 4, the top tube drive shaft heat chamber 26, dome chimney tube 11, the drive shaft 17 with its drive shaft tube relief vents 20, and the rotational vent relief collar 21 with its collar vents 25. While only three drive shaft tube relief vents 20 and three rotational relief collar vents 25 are shown, it is be to understood that the number of such vents is not restricted to three. As shown in FIGS. 3 and 4 the rotational vent relief collar 21 can be provided with a radial extension 24 by which the rotational vent relief collar can be manually rotated with respect to the tube drive shaft 17.

Figure 5:
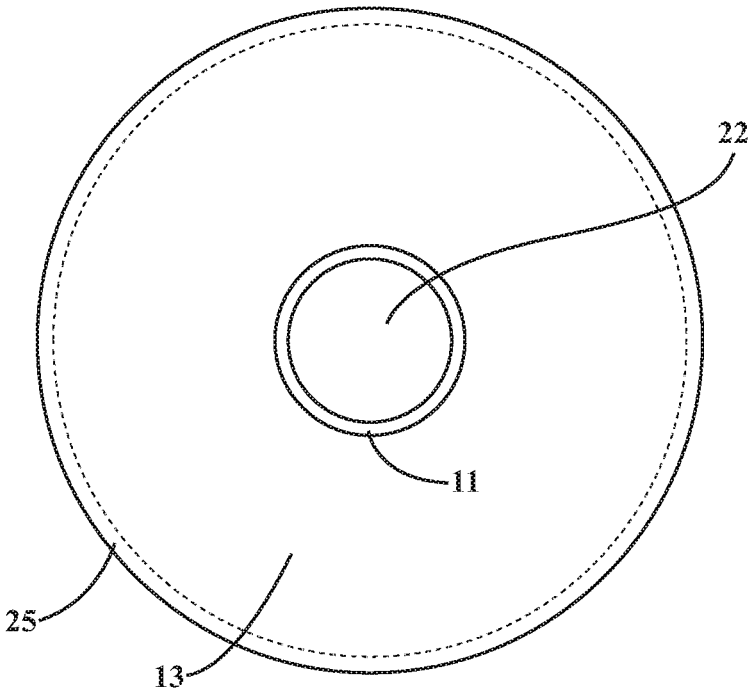
FIG. 5 is a top view of the attachment of the heat dome chimney tube to the dome top according to one embodiment.
Figure 6:
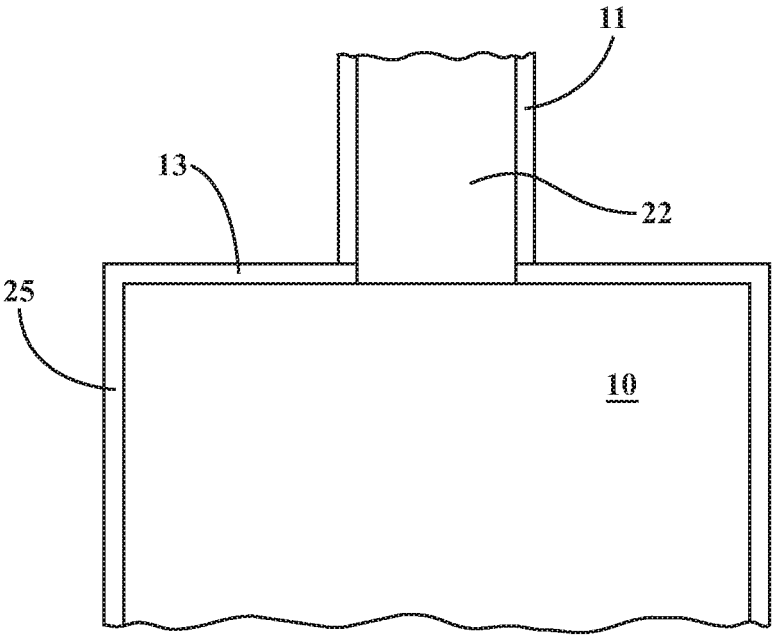
FIG. 6 is a side view of a cutaway of the attachment point of the heat dome top, chimney tube and heat chamber according to one embodiment.

FIG. 5 is a top view of the attachment of the heat dome chimney tube to the dome top according to one embodiment. FIG. 6 is a side view of a cutaway of the attachment point of the heat dome top, chimney tube and heat chamber according to one embodiment.

FIGS. 5 and 6 depict the structure of the heat dome chamber 10 having the heat dome wall 26 and heat dome top 13 and how the dome top 13 and the chimney tube 11 are attached together such that the heat dome chamber 10 air is in communication with the dome chimney tube 11 so that combustion gases entering heat dome chamber 10 can be exhausted through the dome chimney tube stack 22 and exit via the exhaust vent control assembly discussed above.

As discussed and described above the present invention provides for regulating heat in melter kettles that have heat domes. The heat regulating is achieved by providing the dome chimney tube stack 22 described above through which combustion gases in the heat dome chamber 10 can be vented separately from combustion gases that vent from the combustion chamber 6 through the kettle side heat chamber 8 and exhaust stack 9.

The combustion gases that are exhausted through the dome chimney tube stack 22 are regulated by adjusting the alignment of the collar vents 25 formed in the rotational vent relief collar and the drive shaft tube relief vents 20 formed in the tube drive shaft 17.

Temperature sensors can be provided in or near the exhaust stack 9 and top tube drive shaft heat chamber 26 to monitor the temperature of combustion gases that are exhausted at/from these areas. One or more additional temperature sensor(s) can be provided in the combustion chamber 6 and, if desired, in the heat dome chamber 10. Monitored temperatures from these temperature sensors can be used to adjust the alignment of the collar vents 25 and the drive shaft tube relief vents 20 to optimize or regulate heating and melting of thermoplastic material in the melter kettle.

Heat regulation can include throttling the amount of combustion exhaust gases that exit the top tube drive shaft heat chamber 26 in a manner that controls the proportion of ratio of combustion exhaust gases that exit the exhaust stack 9 compared to the amount of combustion exhaust gases that exit and the top tube drive shaft heat chamber, or the rate at which the exhaust gases exit the top tube drive shaft heat chamber 26 from the heat dome chamber. Providing an adjustable vent on the exhaust stack 9 would allow additional control of exhaust gases and temperature regulation. In addition control of the fuel feed to burner 5 could be coordinated with control of exhaust gas venting.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above and set forth in the attached claims.

The invention claimed is:

1. In a melter kettle for melting thermoplastic pavement marking material wherein the melter kettle is provided with a combustion chamber and a heat dome chamber in the bottom of melter kettle, the heat dome chamber defined by a cylindrical wall that is spaced apart from an outer wall of the melter kettle, and a dome top at the top of the cylindrical wall which dome top is spaced apart from a bottom of the melter kettle, the improvement wherein an exhaust gas conduit is provided between the top of the heat dome chamber and the top of the melter kettle through which exhaust gas conduit combustion gases received in the heat dome chamber can be exhausted from the top of the melter kettle.

2. The melter kettle of claim 1, wherein the exhaust gas conduit is provided with cooperating vents that can be adjusted to regulate the flow of exhaust gases therethrough.

3. The melter kettle of claim 1, wherein the cooperating vents are provided in adjacent coaxial rotating structures.

4. The melter kettle of claim 1, wherein the melter kettle further include rotating agitators that rotate about the exhaust gas conduit.

5. The melter kettle of claim 1, wherein the exhaust gas conduit comprises a dome chimney stack tube that is located within a tube drive shaft that rotates about the dome chimney stack tube.

6. The melter kettle of claim 5, further including rotating agitators that are attached to the tube drive shaft to rotate with the tube drive shaft.

7. The melter kettle of claim 5, further including a motor positioned above the top of the melter kettle which drives rotation of the tube drive shaft.

8. The melter kettle of claim 6, further including a motor positioned above the top of the melter kettle which drives rotation of the tube drive shaft.

9. The melter kettle of claim 1, further comprising a kettle side heat chamber through which combustion gases in the combustion chamber can be exhausted.

10. A melter kettle comprising:

an interior space for receiving thermoplastic material to be melted;

a combustion chamber in the bottom of the melter kettle;

a heat dome chamber that extends above the combustion chamber, the heat dome chamber defined by a cylindrical wall that is spaced apart from an outer wall of the melter kettle, and a dome top at the top of the cylindrical wall which dome top is spaced apart from the bottom of the melter kettle; and an exhaust conduit that extends between the heat dome chamber and a top of the melter kettle for exhausting combustion gases received in the heat dome chamber from the combustion chamber.

11. The melter kettle according to claim 10, further comprising cooperating vents that can be adjusted to regulate the flow of exhaust gases through the exhaust conduit.

12. The melter kettle according to claim 11, wherein the cooperating vents are provided in adjacent coaxial rotating structures.

13. The melter kettle according to claim 10, wherein the melter kettle further include rotating agitators that rotate about the exhaust gas conduit.

14. The melter kettle according to claim 10, wherein the exhaust gas conduit comprises a dome chimney stack tube that is located within a tube drive shaft that rotates about the dome chimney stack tube.

15. The melter kettle of claim 14, further including rotating agitators that are attached to the tube drive shaft to rotate with the tube drive shaft.

16. The melter kettle of claim 14, further including a motor positioned above the top of the melter kettle which drives rotation of the tube drive shaft.

17. The melter kettle of claim 15, further including a motor positioned above the top of the melter kettle which drives rotation of the tube drive shaft.

18. The melter kettle of claim 10, further comprising a kettle side heat chamber through which combustion gases in the combustion chamber can be exhausted.

19. A method of melting a thermoplastic material in a melter kettle having a heat dome chamber and a combustion chamber, said method comprising:

providing a melter kettle having a heat dome chamber, the heat dome chamber defined by a cylindrical wall that is spaced apart from an outer wall of the melter kettle, and a dome top at the top of the cylindrical wall which dome top is spaced apart from a bottom of the melter kettle;

charging thermoplastic material into the melter kettle;

combusting a fuel source in the combustion chamber; and exhausting combustion gases from a top of the heat dome chamber to a top of the melter kettle through an exhaust conduit.

20. A method of melting a thermoplastic material in a melter kettle according to claim 19, further comprising adjusting a venting system that controls a flow of combustion gases exhausted though the exhaust conduit.

* * * * *